US008261814B2

(12) United States Patent
Lempa et al.

(10) Patent No.: US 8,261,814 B2
(45) Date of Patent: Sep. 11, 2012

(54) EXHAUST-GAS COOLER

(75) Inventors: Christoph Lempa, Salzkotten (DE); Andreas Roth, Willebadessen (DE); Christian Smatloch, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 610 days.

(21) Appl. No.: 12/464,372

(22) Filed: May 12, 2009

(65) Prior Publication Data

US 2009/0288404 A1 Nov. 26, 2009

(30) Foreign Application Priority Data

May 21, 2008 (DE) ..... 10 2008 024 569

(51) Int. Cl.
*F28F 27/02* (2006.01)

(52) U.S. Cl. ..... 165/103; 165/176; 165/158

(58) Field of Classification Search ..... 165/103, 165/158

See application file for complete search history.

(56) References Cited

U.S. PATENT DOCUMENTS 633,501 A * 9/1899 Byram ..... 165/103
3,250,319 A * 5/1966 Vogt ..... 165/81
3,292,598 A * 12/1966 Miller et al. ..... 122/406.1
3,800,867 A * 4/1974 MacKenzie ..... 165/158
3,920,067 A * 11/1975 Schindler et al. ..... 165/283
5,091,017 A 2/1992 Flanner
6,955,213 B2 * 10/2005 Stonehouse et al. ..... 165/103
7,032,577 B2 * 4/2006 Rosin et al. ..... 123/568.12
7,438,062 B2 * 10/2008 Okawa et al. ..... 123/568.12
2006/0207245 A1 * 9/2006 Yamaguchi et al. ..... 60/320
2009/0056909 A1 * 3/2009 Braun ..... 165/54

FOREIGN PATENT DOCUMENTS

DE 10 2006 012 219 9/2007

* cited by examiner

*Primary Examiner* — Allen Flanigan
(74) *Attorney, Agent, or Firm* — Henry M. Feiereisen, LLC

(57) ABSTRACT

An exhaust-gas cooler includes a housing having a bypass duct and a cooling zone having arranged therein an exhaust-gas cooling duct which includes an entry cooling duct, at least one reversing duct connected to the entry cooling duct, and an exit cooling duct connected to the reversing duct. The reversing duct is constructed to conduct the exhaust-gas flow in opposite direction to a direction of flow in the entry cooling duct and the exit cooling duct. A control element is received in the housing for selectively directing an exhaust-gas flow through the bypass duct or through the cooling zone, with the bypass duct being segregated from a deflection zone of the reversing duct.

11 Claims, 6 Drawing Sheets

EXHAUST-GAS COOLER

CROSS-REFERENCES TO RELATED APPLICATIONS

This application claims the priority of German Patent Application, Serial No. 10 2008 024 569.0, filed May 21, 2008, pursuant to 35 U.S.C. 119(a)-(d), the content of which is incorporated herein by reference in its entirety as if fully set forth herein.

BACKGROUND OF THE INVENTION

The present invention relates to an exhaust-gas cooler.

The following discussion of related art is provided to assist the reader in understanding the advantages of the invention, and is not to be construed as an admission that this related art is prior art to this invention.

Exhaust-gas coolers of a type involved here find application in an EGR system which recirculates exhaust gas from an internal combustion engine to cool the exhaust gas for recirculation. The cooled exhaust-gas recirculation suppresses generation of nitrogen oxides by dropping the combustion temperature in the cylinders of diesel engines for example. An exhaust-gas recirculation valve is used to control an amount of exhaust gas to be conducted through the exhaust-gas cooler after combustion. The exhaust gas is then fed to fresh air required for the combustion process. As a result of the addition of exhaust gas to fresh air, oxygen concentration in the cylinders is lowered and thus the combustion temperature. Cooling the exhaust gas reinforces this effect.

FIG. 1 is an example of a conventional exhaust-gas cooler 1 having a so-called I-configuration. The exhaust-gas cooler 1 has a housing 2 with an inlet side 3 on one end face and an outlet side 4 on the opposite end face. Exhaust gas enters the inlet side 3 via an exhaust-gas entry zone 5 into the housing 2. Arranged in the exhaust-gas entry zone 5 is a control element 6 which pivots about an axis 11 and is constructed to conduct the incoming exhaust-gas flow either to a bypass duct 7 or to a cooling zone 8. The cooling zone 8 has an exhaust-gas cooling duct 9 which extends axially from the entry zone 5 in the direction of an exhaust-gas exit zone 10 on the outlet side 4. In the event, no cooling is desired, for example during initial start or cold start of the internal combustion engine, the control element 6 is switched to allow the flow of exhaust gas to bypass the cooling zone and to flow through the bypass duct which extends over its entire length dimension in parallel relationship to the cooling zone and the exhaust-gas cooling duct 9.

FIG. 2 is another example of a conventional exhaust-gas cooler 12 having a so-called U-configuration with a cartridge-like housing 13. The exhaust-gas cooler 12 has an exhaust-gas cooling duct 9 which extends in the shape of a U through the cooling zone 8. This is shown in FIG. 3. The bypass duct 7 is arranged on the front end and extends perpendicular to the cooling zone 8 or exhaust-gas cooling duct 9. The control element 6 is hereby arranged in the bypass duct 7.

It would be desirable and advantageous to provide an improved exhaust-gas cooler to obviate prior art shortcomings and to significantly improve the cooling capacity in a simple and yet reliable manner.

SUMMARY OF THE INVENTION

According to one aspect of the present invention, an exhaust-gas cooler includes a housing including a bypass duct and a cooling zone having arranged therein an exhaust-gas cooling duct which includes an entry cooling duct, at least one reversing duct connected to the entry cooling duct, and an exit cooling duct connected to the reversing duct, with exhaust gas flowing in the reversing duct in opposite direction to a direction of flow in the entry cooling duct and the exit cooling duct, and a control element received in the housing for selectively directing exhaust gas to flow through the bypass duct or through the cooling zone, wherein the bypass duct is segregated from a deflection zone of the reversing duct.

The present invention resolves prior art problems by conducting the exhaust gas flow at least twice, preferably four times, through the cooling zone of the housing, when the control element closes the bypass duct. This enhances the cooling capacity. The term "exhaust-gas cooling duct" relates hereby to the path of exhaust gas through the cooling zone.

According to another advantageous feature of the present invention, the housing has an exhaust-gas entry zone directing the exhaust gas flow into the entry cooling duct for subsequent flow in a first plane in a direction of a closed rear end which is constructed to deflect the exhaust-gas flow into a first section of the reversing duct for flow in opposite direction to the direction of flow in the entry cooling duct towards the deflection zone. At the rear end, the exhaust gas flow is preferably deflected vertically upwards, i.e. in a second plane of the exhaust-gas cooler which is perpendicular to the first plane. The deflection zone causes the incoming exhaust gas flow from the first section of the reversing duct to flow transversely, i.e. parallel to the first plane of the exhaust-gas cooler, in the direction of a second section of the reversing duct. The exhaust gas flow in the second section of the reversing duct is conducted in a same manner as in the entry cooling duct towards the closed rear end and—as viewed in vertical direction—deflected in the second plane in a direction of the exit cooling duct in which the exhaust gas flow is conducted opposite to the flow direction of exhaust gas in the second section in the direction of an outlet zone to exit the exhaust-gas cooler in a cooled state.

Thus, exhaust gas is able to pass through the cooling zone of the housing four times so that the cooling capacity of the exhaust-gas cooler and the cooling action of recirculated exhaust gas is significantly enhanced. Of course, it is conceivable to add a further reversing duct to allow passage of the exhaust gas through the cooling zone by more than four times.

According to another advantageous feature of the present invention, the first section of the reversing duct may extend in parallel relationship to the entry cooling duct, and the second section of the reversing duct may extend in parallel relationship to the exit cooling duct. The first and second sections of the reversing duct are arranged—as viewed in vertical direction of the exhaust-gas cooler—below the entry cooling duct and exit cooling duct, respectively, and define a third plane in parallel relationship to the first plane as defined by the location of the entry cooling duct and exit cooling duct. Of course, coolant flows around the entry cooling duct as well as the exit cooling duct and at least the first and second sections of the reversing duct. Also, a coolant flow may, of course, be provided at the respective ends, i.e. in the deflection zone at the end.

According to another advantageous feature of the present invention, the partition to segregate the bypass duct from the deflection zone of the reversing duct so as to prevent exhaust gas to migrate from the deflection zone to the bypass duct, may be constructed in the form of a partition wall which—as viewed in vertical direction of the exhaust-gas cooler—is arranged between the bypass duct and the deflection zone. Suitably, the partition wall extends in transverse direction over the entire width of the housing from the exhaust-gas inlet zone in the direction of the exhaust-gas outlet zone.

According to another advantageous feature of the present invention, the control element may be implemented in the form of a double-flap construction. Thus, the control element has two flap elements for arrangement in the bypass duct and the deflection zone, respectively. The flap elements can be arranged on a common flap shaft and so configured that the deflection zone is opened when the bypass duct is closed, to allow exhaust gas to flow through the cooling zone. When the control element closes the deflection zone while opening the bypass duct, exhaust gas is able to flow only through the bypass duct. The flap elements have face areas which are suitably arranged on the flap shaft in 90° offset relationship.

As an alternative, the control element may be implemented in the form of a single-flap construction having a single flap which is arranged only in the bypass duct. There is no flap element in the deflection zone. In other words, when the bypass duct is open, exhaust gas is prevented to flow through the cooling zone. On the other hand, when the bypass duct is closed, exhaust gas is able flow through the cooling zone.

The flap element of the control element may have a circular configuration or tetragonal configuration. Of course, these configurations are to be understood as examples only, and other configurations which generally follow the concepts outlined here are considered to be covered by this disclosure. When the flap element is circular, it is suitable to pass the flap shaft in midsection through the flap element. The flap element may hereby be pivoted in such a way that a passage in the bypass duct is opened or closed. In the double-flap construction configuration, the flap element in the deflection zone is equally pivoted. The passage in the bypass duct as well as deflection zone may suitably be provided with a sealing wall which conforms to the flap element and upon which the flap element rests snugly, when closed.

When the flap element has a tetragonal configuration, the flap shaft is mounted off-center. The flap shaft may hereby be arranged either on the side of the cooling zone or on the opposite end at an outer edge of the flap element so that the entire face area of the flap element can be sealingly pivoted out of or into the respective passage. Of course, the flap shaft may also extend in midsection through the flap element. This configuration is beneficial because the flap element is balanced, i.e. exhaust gas flows against the flap surface evenly on both sides of the flap shaft.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
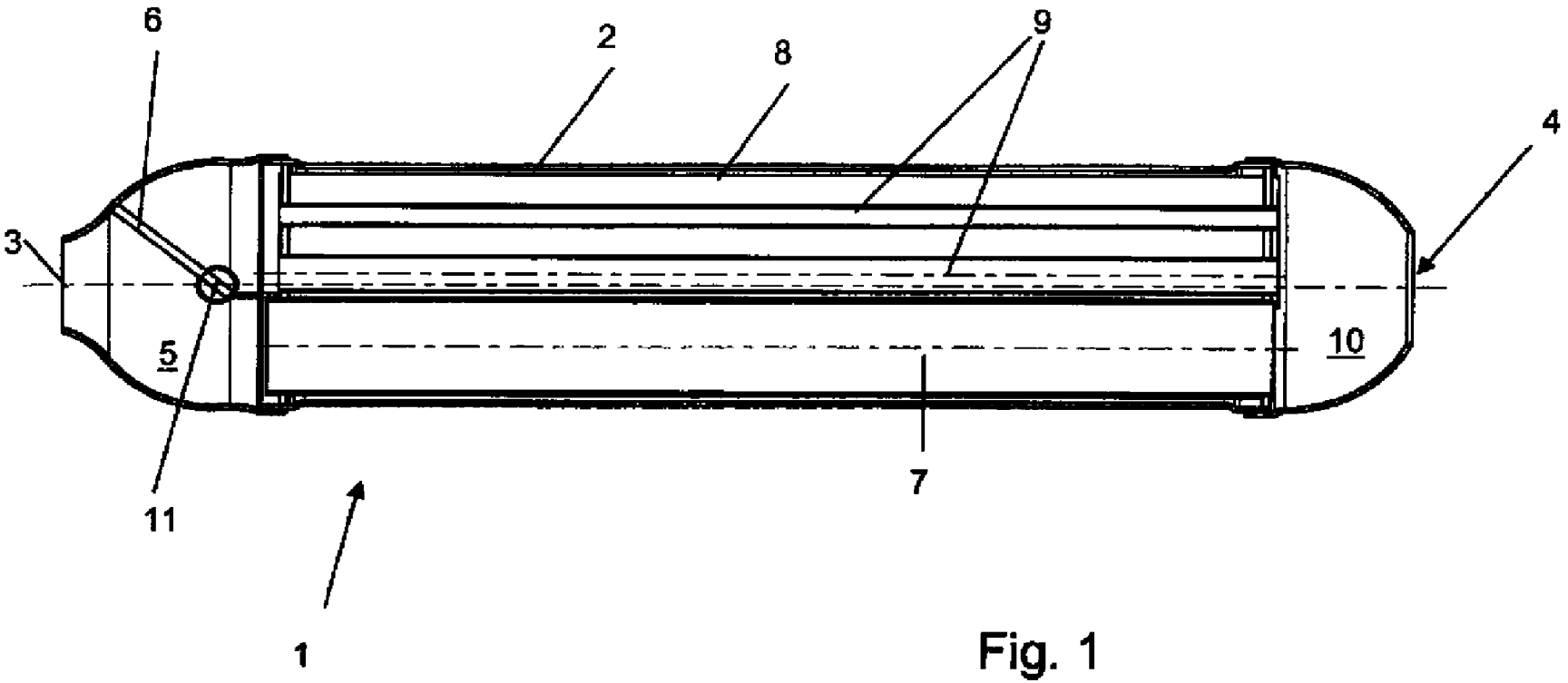
Fig. 1 (Prior Art)
FIG. 1 is a schematic illustration of one example of a conventional exhaust-gas cooler.
Figure 3:
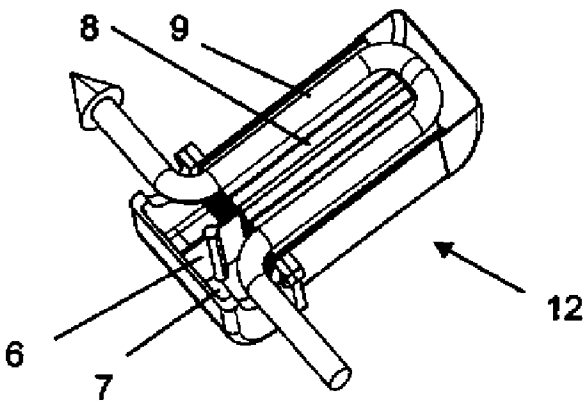
Fig. 3 (Prior Art)
FIG. 3 is a section view of the exhaust-gas cooler of FIG. 2.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 4:
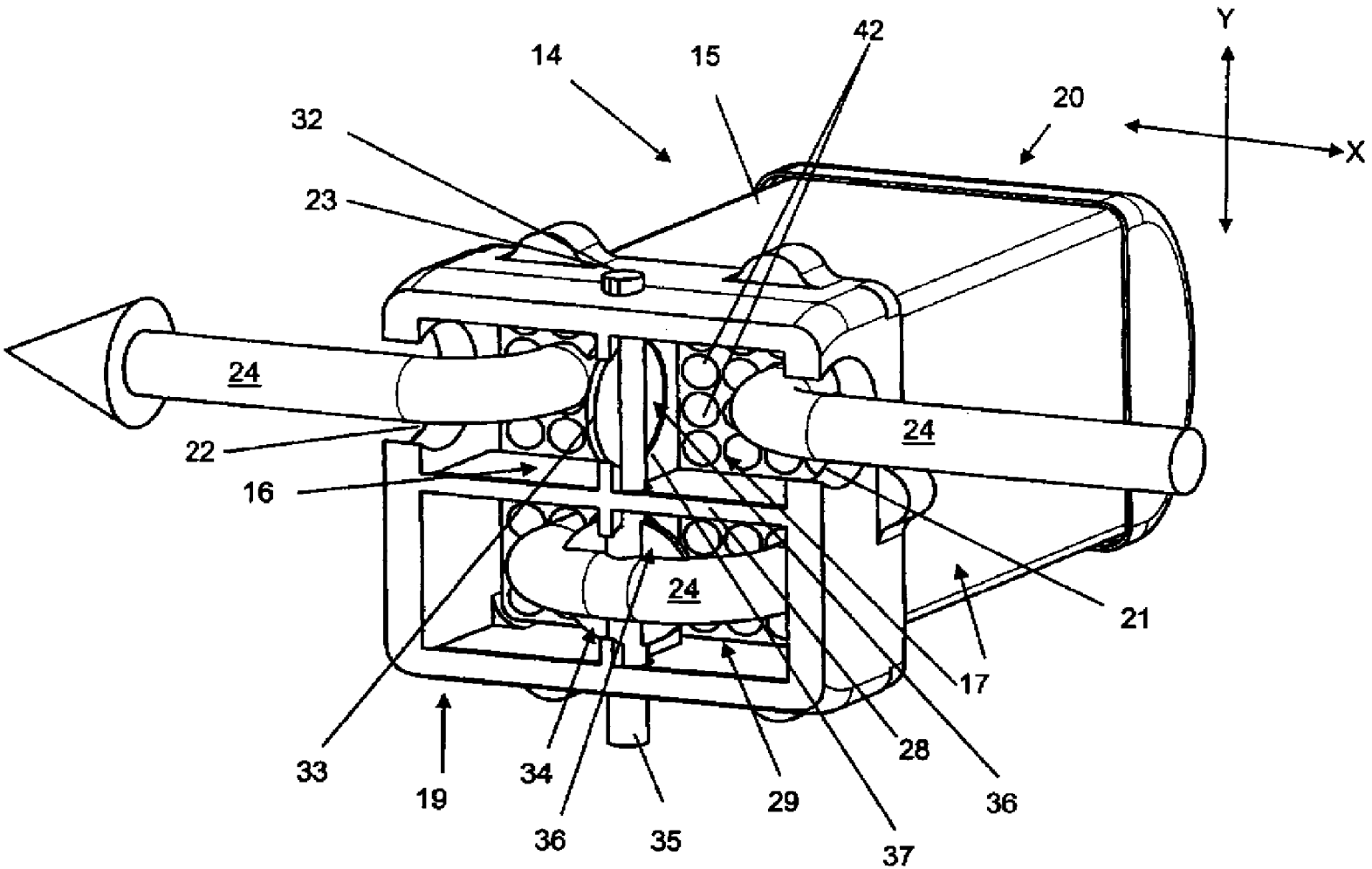
FIG. 4 is a perspective view of one embodiment of an exhaust-gas cooler according to the present invention, having a double-flap control element with circular flap element.

Turning now to the drawing, and in particular to FIG. 4, there is shown a perspective view of one embodiment of an exhaust-gas cooler according to the present invention, generally designated by reference numeral 14. The exhaust-gas cooler 14 has a housing 15 with a bypass duct 16 and a cooling zone 17. Arranged in the cooling zone 17 is an exhaust-gas cooling duct 18 (FIG. 5) which is swept around by a coolant. The term "exhaust-gas cooling duct" is used in the disclosure to relate to the path of the exhaust gas flow, as indicated by arrow 24, through the cooling zone 17 and through the exhaust-gas cooler 14. In the non-limiting example of FIG. 4, the housing 15 has a cartridge-like configuration with a front side 19 and an opposite rear end 20. The bypass duct 16 is arranged at the front side 19. Likewise, an exhaust-gas inlet zone 21, which feeds into the bypass duct 16, and an exhaust-gas outlet zone 22 are arranged on the front side 10, with the exhaust-gas outlet zone 22, as shown by way of example, being situated in opposition to the exhaust-gas inlet zone 21.

A control element 23 is arranged on the front side 19 in the housing 15 to control the exhaust gas flow 24 in such a manner that exhaust gas flows either through the cooling zone 17 and the exhaust-gas cooling duct 18 or through the bypass duct 16. When switching the control element 23 to open the bypass duct 16, exhaust gas flows into the exhaust-gas inlet zone 21, through the bypass duct 16, and exits the exhaust-gas cooler 14 through the exhaust-gas outlet zone 22. In other words, the exhaust gas flow bypasses the cooling zone 17. FIG. 4 shows the situation, in which the control element 23 is switched in such a way as to close the bypass duct 16 so that exhaust gas entering the exhaust-gas cooler 14 through the exhaust-gas inlet zone 21 flows through the cooling zone 17.

The exhaust-gas cooling duct 18 in the cooling zone 17 is constructed to include an entry cooling duct 25, at least one reversing duct 26 connected to the entry cooling duct 25, and an exit cooling duct 27 connected to the reversing duct 26. The reversing duct 26 is hereby constructed with a first section 30 and a second section 31 so that exhaust gas is conducted in the section 30 of the reversing duct 26 in opposition to the flow direction of exhaust gas in the entry cooling duct 25, and conducted in the section 31 in opposition to the flow direction of exhaust gas in the exit cooling duct 27. This is shown in the principle illustration in FIG. 5. The first and second sections 30, 31 are fluidly connected by a deflection zone 29 of the reversing duct 26 on the front side 19, with the bypass duct 16 being segregated from the deflection zone 29 by a partition 28, as shown in FIG. 4.

Figure 2:
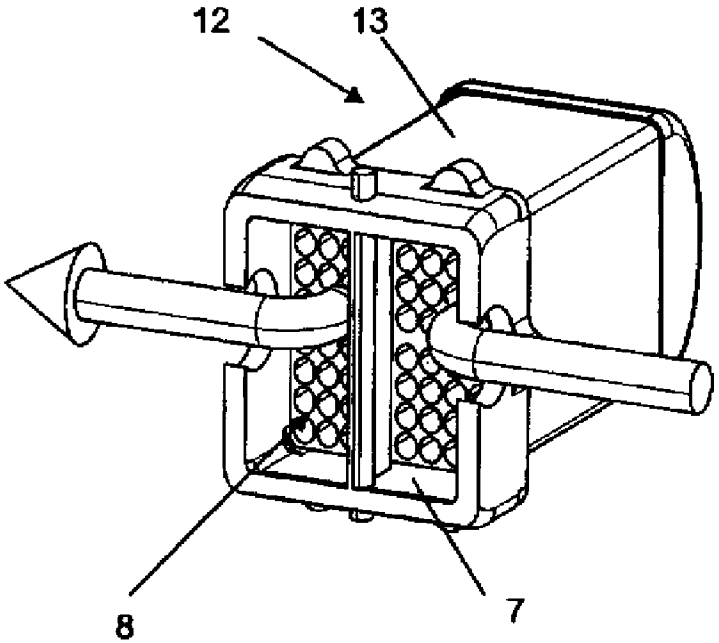
Fig. 2 (Prior Art)
FIG. 2 is a schematic illustration of another example of a conventional exhaust-gas cooler.
Figure 5:
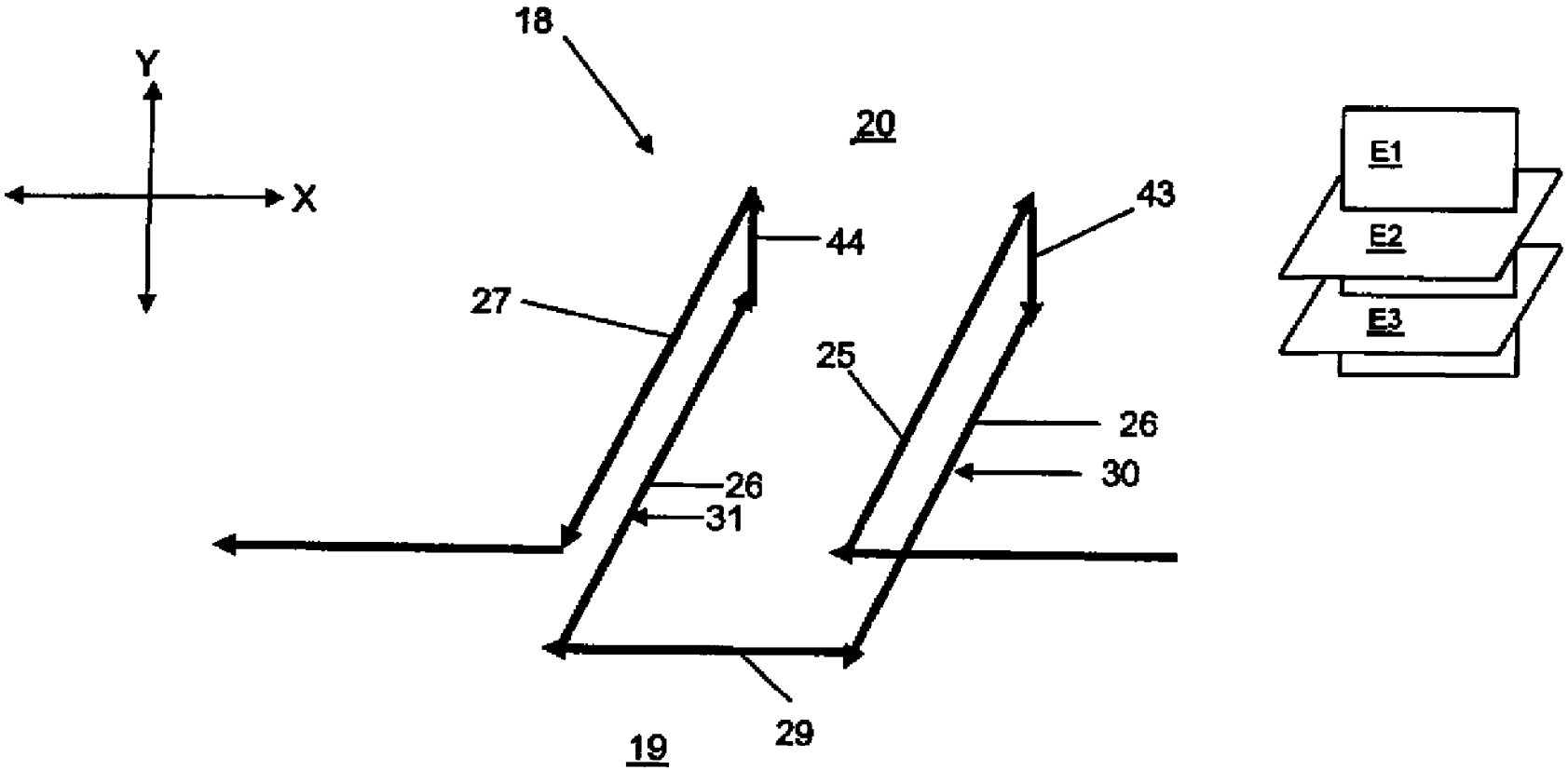
FIG. 5 is a principle illustration of the exhaust gas flow in the exhaust-gas cooler of FIG. 4.

As shown by the principle illustration in FIG. 5, exhaust gas flows through a canny deflection within the cooling zone 17, for example by looping it four times through the cooling zone 17, thereby significantly increasing the cooling capacity of the exhaust-gas cooler 14 when compared for example to the conventional exhaust-gas cooler 12 according to FIG. 2 with identical outer geometry.

More specifically, exhaust gas flows in a first plane E1 via the exhaust-gas inlet zone 21 into the entry cooling duct 25 and toward the rear end 20. In the area of the rear end 20, exhaust gas is conducted in the direction of the first section 30 of the reversing duct 26. The exhaust gas flow is hereby deflected in a second plane E2 downwards (arrow 43), as viewed in vertical direction Y, to reach the first section 30 of the reversing duct 26 which extends suitably in parallel relationship below the entry cooling duct 25 in a third plane E3. The exhaust gas flow in the section 30 of the reversing duct 26 is conducted to the deflection zone 29 on the front side 19 in opposite direction to the flow of exhaust gas in the entry cooling duct 25. The exhaust gas flow is are deflected in deflection zone 29 in a transverse direction X of the third plane E3 and enters the second section 31 of the reversing duct 26. The section 31 conducts the exhaust gas flow 24 in the direction of the rear end 20 in a same direction as the flow direction in the entry cooling duct 25. At the rear end 20, the exhaust gas flow 24 is deflected in the second plane E2 upwards (arrow 44) in vertical direction Y and enters the exit cooling duct 27. The exhaust gas flow 24 is conducted in the exit cooling duct 27 in the first plane E1 in the direction of the front side 19, i.e. in opposition to the flow direction in the second section 31 of the reversing duct 26 but in the same flow direction as the flow direction in the first section 30 of the reversing duct 26.

The partition 28 is suitably implemented as partition wall extending between the bypass duct 16 and the deflection zone 29 at the front side 19 in transverse direction X continuously from the exhaust-gas inlet zone 21 in the direction of the exhaust-gas outlet zone 22 (FIG. 4). The front side 19 is thus virtually split in half, as viewed in vertical direction Y. The upper half in the drawing plane effectively represents the bypass duct 16 whereas the lower half in the drawing plane effectively represents the deflection zone 29. The bypass duct 16 and the deflection zone 29 are suitably segregated from one another in a gastight manner. Of course, the location of the bypass duct 16 and the deflection zone 20 may also be reversed, i.e. the lower half represents the bypass duct 16 and the upper half represents the deflection zone 29. Without departing from the scope of the invention, it is, of course, also feasible to place the partition 28 off-center, i.e. shifted upwards or downwards as viewed in vertical direction Y.

In the exemplary embodiment of FIG. 4, the control element 23 is designed as double-flap construction 32 which has a flap element 33 associated to the bypass duct 16 and a flap element 34 associated to the deflection zone 29. Both flap elements 33, 34 have, by way of example, a circular configuration and are mounted on a common flap shaft 35. The flap shaft 35 is placed in midsection of both flap elements 33, 34 and supported on the housing 15 to be able to pivot the flap elements 33, 34 into opening and closing positions. The flap elements 33, 34 have surfaces 36 disposed in 90° offset relationship. As a result, the bypass duct 16 can be closed so that exhaust gas can flow through the cooling zone 17, while the deflection zone 29 is open at the same time. This situation is shown in FIG. 4. On the other hand, when the upper flap element 33 in the drawing plane opens the bypass duct 16, exhaust gas is able to flow through the bypass duct 16, while the deflection zone 29 is closed.

In their closed position, the flap elements 33, 34 rest snugly against the respective sealing walls 37 and clear a passage when the flap elements 33, 34 do not bear against the sealing walls 37.

Figure 6:
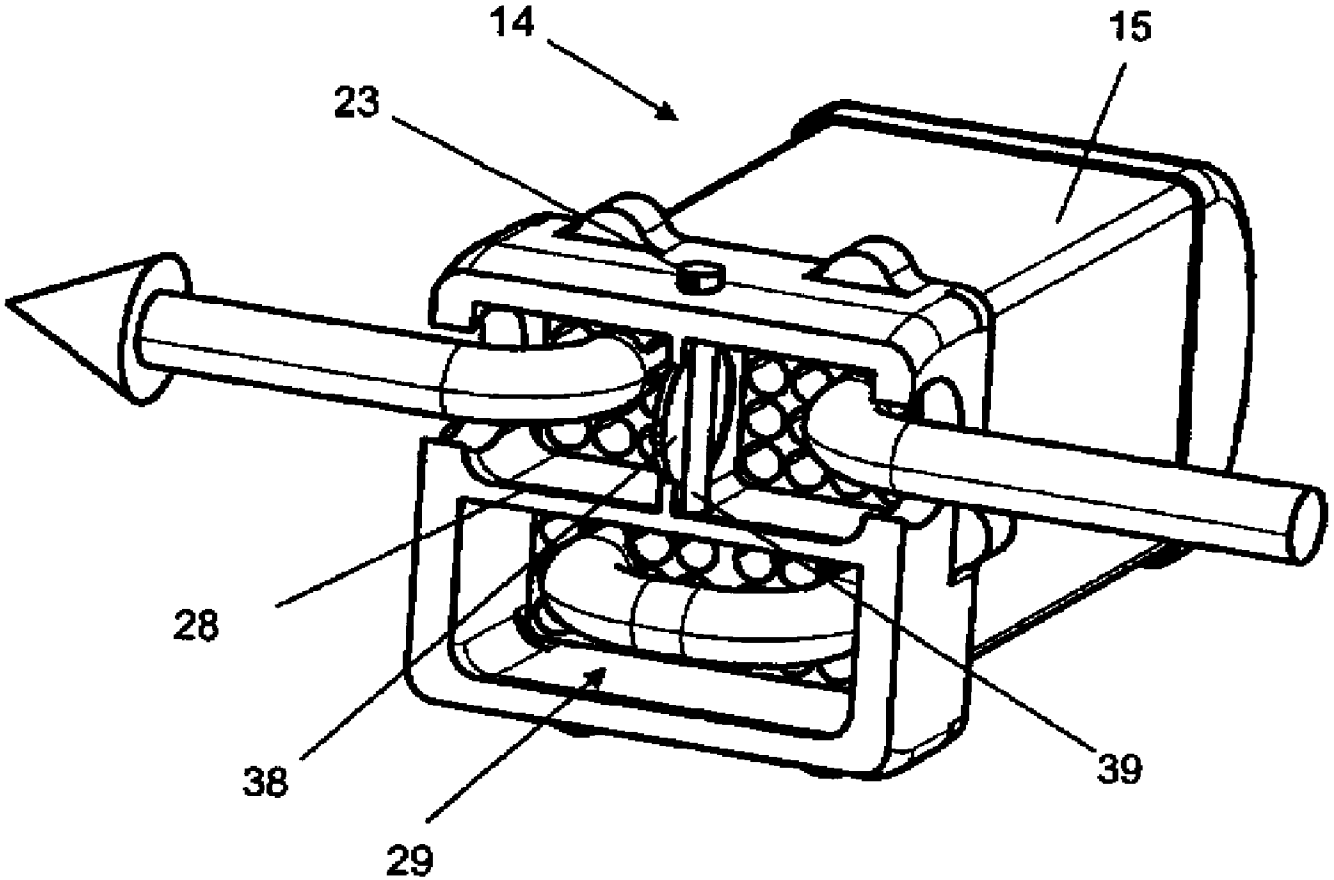
FIG. 6 is a perspective view of another embodiment of an exhaust-gas cooler according to the present invention, having a single-flap control element with circular flap element.

Turning now to FIG. 6, there is shown a perspective view of another embodiment of an exhaust-gas cooler 14 according to the present invention. Parts corresponding with those in FIG. 4 are denoted by identical reference numerals and not explained again. The description below will center on the differences between the embodiments. In this embodiment, provision is made for a control element 23 implemented as single-flap construction having flap element 38 mounted on a flap shaft 39 which is supported in the housing 15 as well as in the partition 28. No flap element is provided in the deflection zone 29. When the flap element 38 is open, exhaust gas flows in the bypass duct 16 from the exhaust-gas inlet zone 21 in the direction of the exhaust-gas outlet zone 22. No exhaust gas flows in the deflection zone 29.

Figure 7:
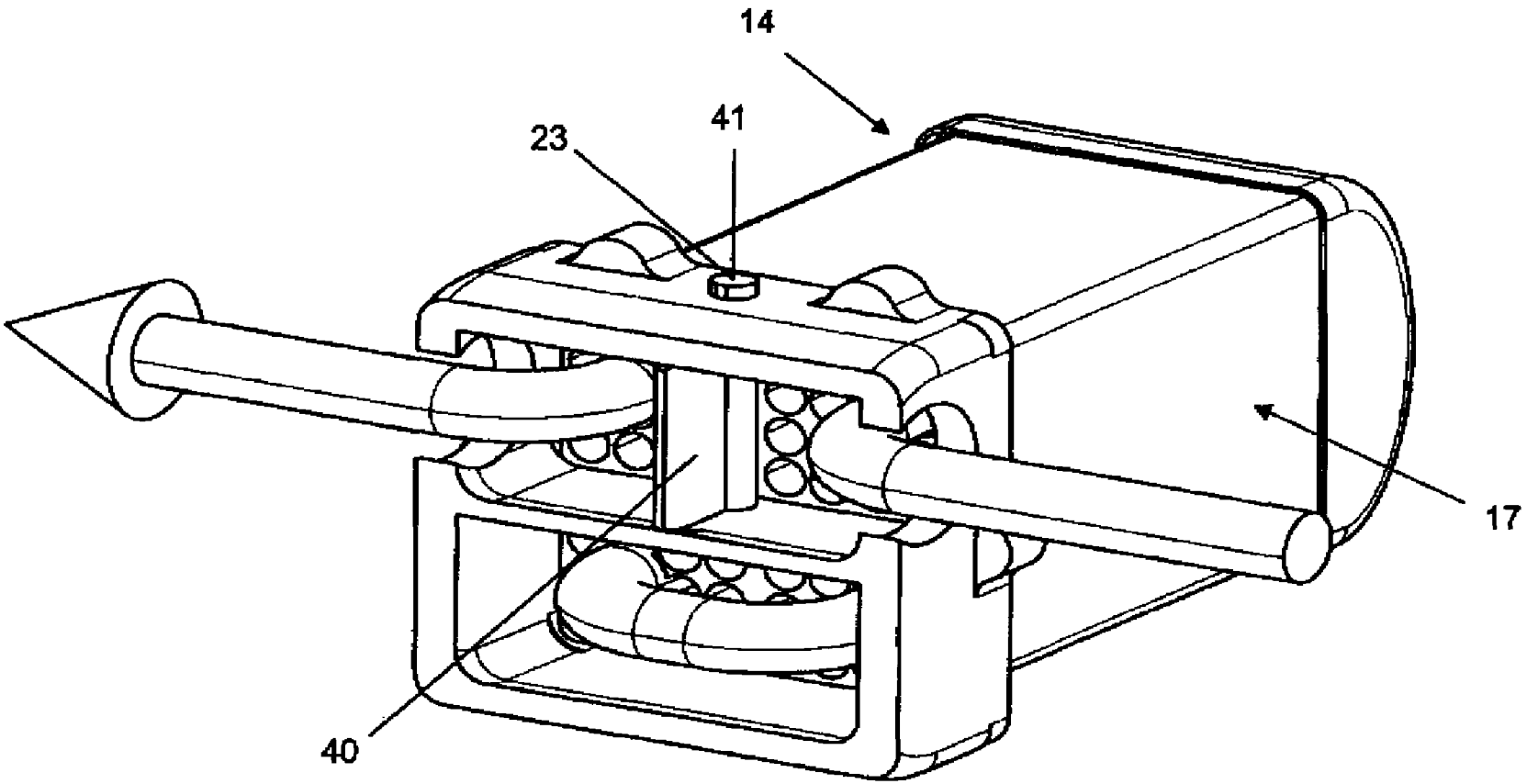
FIG. 7 is a perspective view of yet another embodiment of an exhaust-gas cooler according to the present invention, having a single-flap control element with tetragonal flap element.

FIG. 7 shows a perspective view of yet another embodiment of an exhaust-gas cooler according to the present invention. Parts corresponding with those in FIG. 4 are denoted by identical reference numerals and not explained again. The description below will center on the differences between the embodiments. In this embodiment, provision is made for a control element 23 implemented as single-flap construction having a flap element 40 of tetragonal configuration. The control element 23 has a flap shaft 41 which extends in the area of the cooling zone 17 and carries the flap element 40. Pivoting the flap element 40 by 90° from the position shown in FIG. 7 causes the bypass duct 16 to open while the cooling zone 17 is, preferably fully, closed, with the single flap element 40 having a suitably matching flap geometry. Of course, the flap shaft 41 may also be arranged on the opposite side on an outer side or in midsection. It will be understood by persons skilled in the art that the control element 23 may equally be implemented as a double-flap construction with tetragonal flap elements.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An exhaust-gas cooler, comprising:

a housing including a bypass duct and a cooling zone having arranged therein an exhaust-gas cooling duct which includes an entry cooling duct, at least one reversing duct connected to the entry cooling duct, and an exit cooling duct connected to the reversing duct, with exhaust gas flowing in the reversing duct in opposite direction to a direction of flow in the entry cooling duct and the exit cooling duct; and a control element implemented in the form of a double-flap construction and received in the housing for selectively directing exhaust gas to flow through the bypass duct or through the cooling zone, wherein the control element has two flap elements arranged on a common flap shaft and so configured that the deflection zone is opened when the bypass duct is closed, or vice versa.

2. The exhaust-gas cooler of claim 1, wherein the housing has an exhaust-gas entry zone directing the exhaust gas flow into the entry cooling duct for subsequent flow in a direction of a rear end which is constructed to deflect the exhaust-gas flow into a first section of the reversing duct for flow in opposite direction to the direction of flow in the entry cooling duct towards the deflection zone by which the exhaust-gas flow is deflected to flow into a second section of the reversing duct towards the rear end which deflects the exhaust-gas flow in a direction of the exit cooling duct for subsequent flow to an exhaust-gas exit zone of the housing.

3. The exhaust-gas cooler of claim 1, wherein the first section of the reversing duct extends in parallel relationship to the entry cooling duct, and the second section of the reversing duct extends in parallel relationship to the exit cooling duct.

4. The exhaust-gas cooler of claim 1, further comprising a partition placed between the bypass duct and the deflection zone of the reversing duct to segregate the bypass duct from a deflection zone of the reversing duct.

5. The exhaust-gas cooler of claim 1, wherein the control element is implemented in the form of a single-flap construction having a flap element arranged in the bypass duct.

6. The exhaust-gas cooler of claim 1, wherein the reversing duct has a U-shaped configuration defined by a first section in vertically spaced-apart relationship to the entry cooling duct, and a second section in vertically spaced-apart relationship to the exit cooling duct, with the deflection zone interconnecting the first and second sections.

7. The exhaust-gas cooler of claim 4, wherein the housing defines a longitudinal axis and has an exhaust-gas inlet zone and an exhaust-gas outlet zone on opposite ends of the housing, said partition extending in a direction transversely to the longitudinal axis over an entire width of the housing from the exhaust-gas inlet zone in the direction of the exhaust-gas outlet zone.

8. The exhaust-gas cooler of claim 1, wherein the flap elements have surfaces which are arranged on the flap shaft in 90° offset relationship.

9. The exhaust-gas cooler of claim 1, wherein the control element has a flap element of circular configuration.

10. The exhaust-gas cooler of claim 1, wherein the control element has a flap element of tetragonal configuration.

11. The exhaust-gas cooler of claim 10, wherein the control element has a flap shaft extending off-center through the flap element.

* * * * *